US009642409B2

(12) United States Patent
Roesler

(10) Patent No.: US 9,642,409 B2
(45) Date of Patent: May 9, 2017

(54) INDUSTRIAL IMPACT PROTECTION HELMET

(75) Inventor: Peter Roesler, Wangen (DE)

(73) Assignee: Rose Plastic AG (DE)

( * ) Notice: Subject to any disclaimer, the term of this patent is extended or adjusted under 35 U.S.C. 154(b) by 1035 days.

(21) Appl. No.: 12/674,593

(22) PCT Filed: Aug. 20, 2008

(86) PCT No.: PCT/EP2008/006828

§ 371 (c)(1),
(2), (4) Date: Aug. 1, 2011

(87) PCT Pub. No.: WO2009/024330

PCT Pub. Date: Feb. 26, 2009

(65) Prior Publication Data

US 2011/0271426 A1 Nov. 10, 2011

(30) Foreign Application Priority Data

Aug. 20, 2007 (DE) ..... 10 2007 039 287

(51) Int. Cl.

| | |
|---|---|
| ***A42B 1/08*** | (2006.01) |
| ***A42B 3/06*** | (2006.01) |
| ***A42B 3/32*** | (2006.01) |

(52) U.S. Cl.

CPC ..... *A42B 1/08* (2013.01); *A42B 3/06* (2013.01); *A42B 3/324* (2013.01)

(58) Field of Classification Search

CPC ..... A41D 13/0153; A41D 13/0158; A41D 13/0005; A42B 1/008; A42B 1/201; A42B 3/04; A42B 3/064; A42B 3/065; A42B 3/068; A42B 3/069; A42B 3/127; A42B 1/20; A42B 1/208; A42B 1/08; A42B 3/06; A42B 3/324

USPC ..... 2/410, 6.6, 6.8, 7, 8, 411, 416, 417, 418, 2/419, 420, 421, 425, 171.1, 182.2, 183

See application file for complete search history.

(56) References Cited

U.S. PATENT DOCUMENTS

| | | | | | |
|---|---|---|---|---|---|
| 2,058,146 | A | * | 10/1936 | Glidden | 2/418 |
| 2,415,250 | A | * | 2/1947 | La Belle | 2/195.7 |
| 2,594,906 | A | * | 4/1952 | Gardner | 2/171.01 |
| 2,794,189 | A | * | 6/1957 | Nesbit et al. | 2/182.1 |
| 2,861,272 | A | * | 11/1958 | Stuart et al. | 2/6.6 |
| 2,889,555 | A | * | 6/1959 | Stuart et al. | 2/6.6 |
| 3,082,429 | A | * | 3/1963 | De Villers | 2/195.7 |
| 3,107,356 | A | * | 10/1963 | Pestronk et al. | 2/420 |
| 3,204,251 | A | * | 9/1965 | Child | 2/420 |
| 3,665,514 | A | * | 5/1972 | Durand | 2/420 |
| 3,991,422 | A | * | 11/1976 | Saotome | 2/410 |
| 4,404,690 | A | * | 9/1983 | Farquharson | 2/420 |
| 4,429,420 | A | * | 2/1984 | Wolff | 2/175.1 |

(Continued)

FOREIGN PATENT DOCUMENTS

FR 2894784 A1 * 6/2007

*Primary Examiner* — Alissa L Hoey

(74) *Attorney, Agent, or Firm* — Cohen & Grigsby, P.C.

(57) ABSTRACT

The impact protection cap manufactured from a bendable synthetic material comprises at least one middle shell (3), connected in the forehead area of the wearer by means of flexible areas (12, 13) to lateral shells (1, 2) appended to the sides thereof, characterized in that the lateral shells (1, 2) extend at least partially over the middle shell (3) thereby building overlapping areas (22, 22') wherebetween ventilation slots (7, 8) are formed.

10 Claims, 5 Drawing Sheets

(56) References Cited

U.S. PATENT DOCUMENTS

Figure 1:
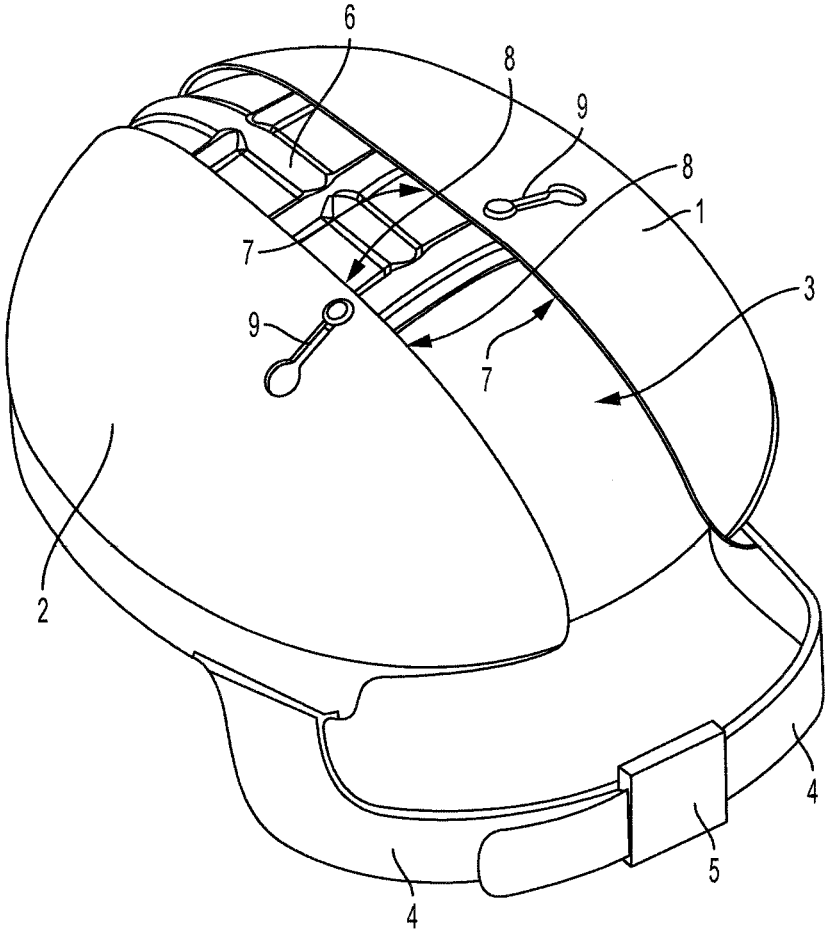

| | | | | | |
|---|---|---|---|---|---|
| 4,607,397 | A * | 8/1986 | Laxo | 2/410 |
| 4,665,569 | A * | 5/1987 | Santini | 2/425 |
| 4,670,910 | A * | 6/1987 | Rosasco | 2/200.3 |
| 4,827,537 | A * | 5/1989 | Villa | 2/410 |
| 4,864,662 | A * | 9/1989 | Frank | 2/183 |
| 5,012,533 | A * | 5/1991 | Raffler | 2/420 |
| 5,094,229 | A * | 3/1992 | Pomatto et al. | 602/17 |
| 5,421,799 | A * | 6/1995 | Rabin et al. | 601/71 |
| 5,428,842 | A * | 7/1995 | Wise | 2/195.1 |
| 5,448,780 | A * | 9/1995 | Gath | 2/424 |
| 5,481,759 | A * | 1/1996 | Rinaldi | 2/195.1 |
| 5,515,546 | A * | 5/1996 | Shifrin | 2/410 |
| 5,544,367 | A * | 8/1996 | March, II | 2/410 |
| 5,581,818 | A * | 12/1996 | Lorenzi et al. | 2/411 |
| 5,930,841 | A * | 8/1999 | Lampe et al. | 2/411 |
| 6,092,239 | A * | 7/2000 | Pogrebitsky et al. | 2/200.3 |
| 6,154,889 | A * | 12/2000 | Moore et al. | 2/418 |
| 6,209,139 | B1 * | 4/2001 | Schmidt et al. | 2/171.1 |
| 6,266,827 | B1 * | 7/2001 | Lampe et al. | 2/414 |
| 6,349,416 | B1 * | 2/2002 | Lampe et al. | 2/411 |
| 6,381,760 | B1 * | 5/2002 | Lampe et al. | 2/425 |
| 6,428,494 | B1 * | 8/2002 | Schwenn et al. | 602/17 |
| 6,442,765 | B1 * | 9/2002 | Fallon et al. | 2/410 |
| 6,453,475 | B1 * | 9/2002 | Johnson | 2/209.11 |
| 6,715,156 | B1 * | 4/2004 | Purnell | 2/425 |
| 6,751,808 | B2 * | 6/2004 | Puchalski | 2/411 |
| 7,076,811 | B2 * | 7/2006 | Puchalski | 2/411 |
| 7,958,572 | B2 * | 6/2011 | Loury et al. | 2/410 |
| 7,958,573 | B2 * | 6/2011 | Lewis et al. | 2/414 |
| 8,042,198 | B1 * | 10/2011 | Cleveland | 2/411 |
| 8,146,177 | B2 * | 4/2012 | Mangone | 2/417 |
| 8,510,870 | B2 * | 8/2013 | Rogers et al. | 2/418 |
| 2002/0178486 | A1 * | 12/2002 | Kovalenko | 2/195.2 |
| 2004/0181854 | A1 * | 9/2004 | Primrose | 2/411 |
| 2004/0255369 | A1 * | 12/2004 | Puchalski | 2/410 |
| 2005/0257312 | A1 * | 11/2005 | Puchalski | 2/411 |
| 2006/0143794 | A1 * | 7/2006 | Hou | 2/200.3 |
| 2007/0157370 | A1 * | 7/2007 | Joubert Des Ouches | 2/410 |
| 2008/0295228 | A1 * | 12/2008 | Muskovitz | 2/412 |
| 2012/0144564 | A1 * | 6/2012 | Alexander et al. | 2/410 |

* cited by examiner

INDUSTRIAL IMPACT PROTECTION HELMET

The invention relates to an industrial impact protection cap such as those known to the art, for example, from the subject matter of the patent application DE 602 09 726 T2. An industrial impact protection cap of this type is suitable to be worn under a peaked hat manufactured of a textile material. The impact protection cap itself preferably is manufactured of a synthetic material, though the use of a metallic material is possible. The purpose of an industrial impact protection cap of this type is the ability to be worn under a peaked hat while being kept as far as possible concealed and still to protect the head to the greatest extent possible from blows, damages, and injuries.

The subject matter of the patent application DE 602 09 726 T2 shows an impact protection cap of this type manufactured essentially of a single piece of synthetic material building a middle shell with lateral shells moulded thereto respectively by means of bendable areas. A disadvantage of said design is, however, the fact that the connection areas between the middle shell and the lateral shell are also open while the impact protection cap is being worn. This means that said shells are interconnected as one piece of material by means of bendable areas only in the forehead area while building open lateral slots in direction of the area of the back of the head. Thereby, a dimensional adaptation of the shells to the head shape is to be achieved by having the slots more or less closed depending on the head shape of the wearer.

Since however a head protection cap of this type has to be suitable for the most diverse head shapes, it should be assumed that the slots extending into the area of the back of the head will always remain open thereby causing an increased risk of injury. In said areas, the head remains unprotected. Pointed objects can then dip through said slot area and injure the scalp.

The development mentioned therefore entails the disadvantage that complete protection of the entire head is not established.

A further disadvantage of said technology known to the art lies in the lack of a longitudinal guide or of a defined coordination of the lateral shells to the middle shell. Said shells are only interconnected by means of bendable areas in the area of the back of the head. Guidance of the lateral shells on the middle shell in the frontal area and the forehead area of the head is, however, not ensured. This entails the disadvantage that the lateral shells may independently from one another be deformed in relation to the middle shell and, for example, lift off from the head, which will cause an uncomfortable wearing sensation.

This kind of loss of wearing comfort considerably impairs the acceptance of impact protection caps of this type.

There is therefore a lack of even pressure distribution of the lateral shells in relation to the middle shell as related to the head shape of the wearer because the lateral shells may be deformed independently from the middle shell.

With the subject matter of the patent application DE 200 15 885 U1, a further impact protection cap has become known to the art, wherein lateral shells are moulded onto a middle shell respectively by means of lateral bendable areas. Here again, there is the disadvantage that large, spacious slots exist in the connection area between the lateral shells and the middle shell, due to which again the head area is not completely protected. An equal disadvantage, moreover, exists with the U.S. Pat. No. 2,794,189 providing a perforated headband encircling the head only on the circumference, with a cover shell moulded onto said headband as one piece of material. Here as well unfavourable perforation areas between the head shell and the headband are generated, which in turn impairs the complete protection of the head.

If on the other hand, an integral helmet is used, such as described for example in the U.S. Pat. No. 5,930,841 A1, the disadvantage exists that an unfavourable adaptation to the head shape of the wearer has to be accepted. Corresponding to the head shape size then, corresponding inserts have to be applied on the inside in order to achieve an adaptation to the head shape. The same is true, moreover, for the U.S. Pat. No. 5,581,818 and U.S. Pat. No. 5,481,759.

The object of the invention therefore is the further development of an industrial impact protection cap of the aforementioned type—starting from the patent application DE 602 09 726 T2—in such a way that the same ensures complete protection of the entire head while providing high wearing comfort and good ventilation.

In order to achieve said object, the invention is characterized by the enabling disclosure of claim 1.

An essential feature of the invention lies in the fact that the lateral shells and the middle shell are interconnected as one piece of material in the frontal head area in a manner per se known to the art, building bendable areas in that space, and that the lateral shells extend at least partially over the middle shell thereby forming overlap areas wherebetween ventilation slots are constructed.

With the given enabling disclosure, the essential advantage arises that now the invention provides for the lateral shells to extend at least partially over the middle shell where they are to be adjustably guided on the middle shell.

Moreover, the invention is not limited to the provision that the impact protection cap be worn under a textile hat. The possibility is also provided to wear the impact protection cap alone without textile cover or to wear the impact protection cap with other textile or non-textile head covers.

Thereby, several advantages arise simultaneously:

1. Due to the controlled overlap of the lateral shells, respectively partially overlapping the middle shell, complete uninterrupted protection of the entire head over the entire head length is generated.
2. Due to the at least partial overlap of the respective lateral shell on the middle shell, favourable lateral ventilation slots are generated there, said ventilation slots forming a particularly good ventilation cross section.
3. An excellent adaption to the head shape is generated because the lateral shells are guided on the middle shell in the area of a respective longitudinal guide (oriented crosswise to the longitudinal head direction) and the two lateral shells can respectively be adjusted separately from one another in relation to the middle shell.

Therefore it is no longer possible—as in the prior art—for the lateral shell to lift off from the middle shell on the left side and not on the right side, which would impair the wearing sensation. In this manner, a complete adaptation to the head shape of the wearer over the entire internal area of the impact protection cap is achieved because, based on said longitudinal guide, the lateral shells are guided on the middle shell in crosswise direction to the longitudinal head direction in a way to be adjustable independently from one another. Thus even asymmetrical head shapes can be favourably adjusted and the entire load of the impact protection cap can be evenly distributed over the head circumference.

4. Due to the overlap of the two lateral shells adjustably extending over a central middle shell, the middle shell is placed on a lower in relation to the lateral shells located on a higher level. Therefore, long ventilation slots can be constructed in said transitional area, the air flowing out of said ventilation slots at a high degree of effectiveness, when an air flow flows in the direction of the longitudinal head axis over the lower-lying area of the middle shell. The latter then cooperates with the appended higher-lying front surfaces of the lateral shells to form a semi-open flow channel.

A preferred development of the invention provides for said shells to be manufactured of a given material that may be an integral synthetic material which is particularly thin and bendable. A synthetic material of this type is, for example, a synthetic material having approximately a thickness of 1.5 through 2 millimeters, whereby an excellent bendability of the shells is generated.

Based on said bendability, it is even possible to design the middle shell as freely bendable and to, for example, construct a flap onto the back of the head, said flap being freely bendable because it is attached at the freely bendable end of the middle shell so that said back-of-the-head flap on the middle shell adapts particularly favourably to the area of the back of the head of the wearer at the internal sides of the lateral shells.

In the forehead area, the lateral shells are preferably interconnected with the middle shell by means of bendable areas constructed as one piece of material, and in said area, a connective plate is disposed building the corresponding bendable zones—if warranted, placed perpendicular to one another.

Equally it is preferred to have a longitudinal and crosswise ribbing disposed at least in the area of the middle shell.

The lateral shells extend at least partially over said longitudinal and crosswise ribbing, providing spacing, so that in the area of said ribbing, the aforementioned ventilation slots are formed effecting the aforedescribed venturi effect.

The invention is not limited to an isolated ribbing of the middle shell. It may also be provided to have the lateral shells equally carry a ribbing.

The ribbing in the area of the middle shell, however, is particularly preferred because the ribs then simultaneously form the spacing for the ventilation slots in the area to the smoothly constructed internal side of the lateral shells.

Based on the flexible construction of the lateral shells in crosswise as well as in longitudinal direction and equally on the flexible construction of the middle shell in crosswise and longitudinal direction, a flexible adaptation of the entire impact protection cap to any head shape in longitudinal as well as also in crosswise direction is generated. This fact is novel and was unknown to the prior art.

The subject matter of the present invention does not only derive from the subject matter of the individual patent claims, but also from the combination of the individual patent claims among one another.

All data and features disclosed in the documentation, including the abstract, and in particular, the spatial structure represented in the drawings are claimed as essential for the invention in so far as they are novel individually or in combination in relation to the prior art.

Below, the invention is explained in more detail with reference to drawings representing only one embodiment. Further features and advantages essential for the invention ensue from the drawings and the description thereof.

Figure 2:
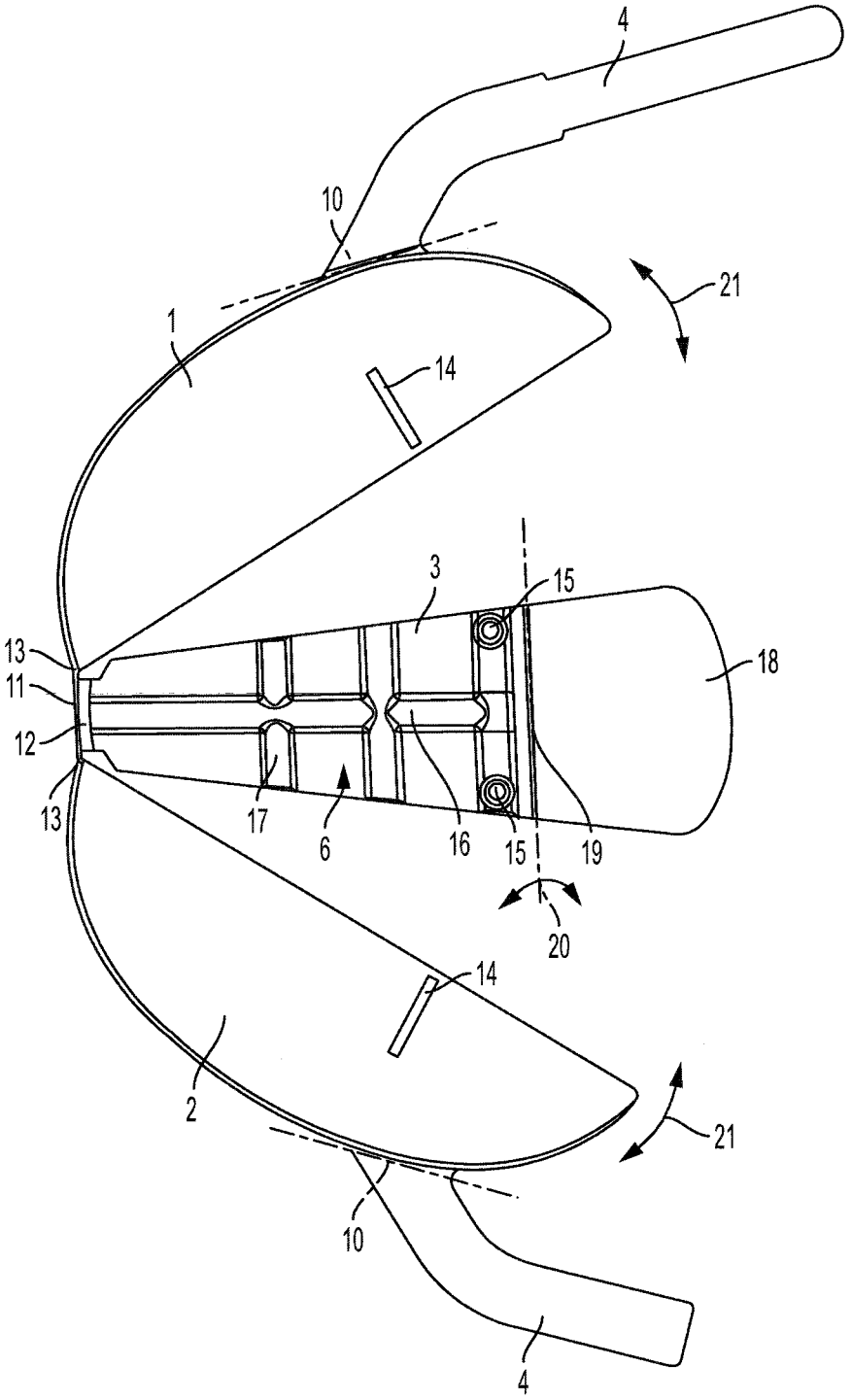
Figure 3:
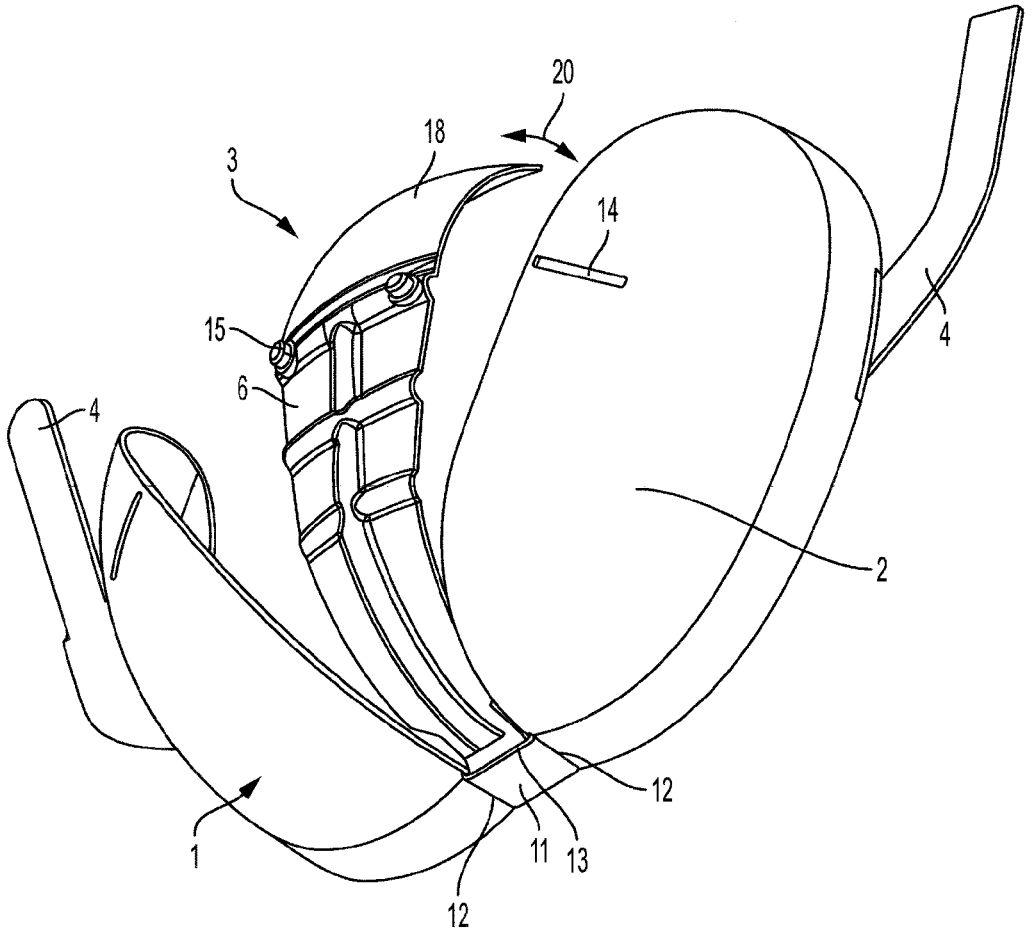
Figure 5:
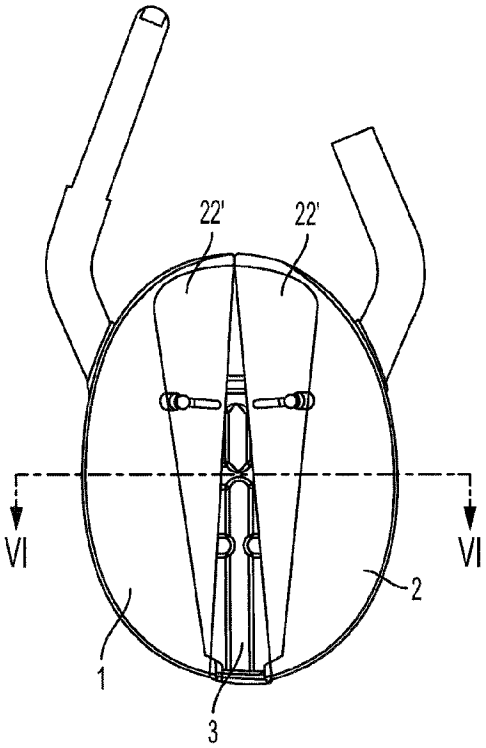
Figure 4:
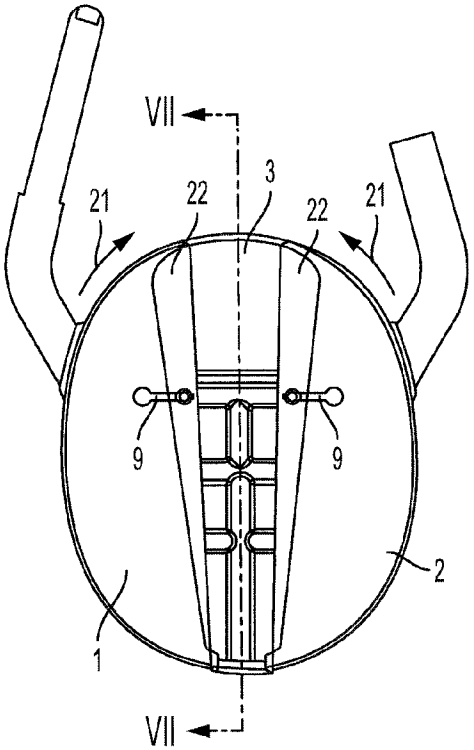
Figure 6:
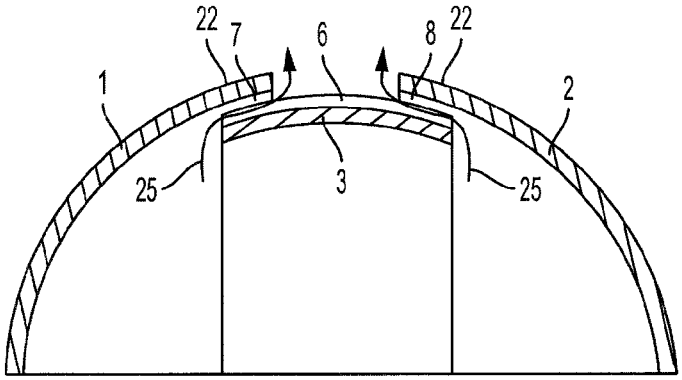
Figure 7:
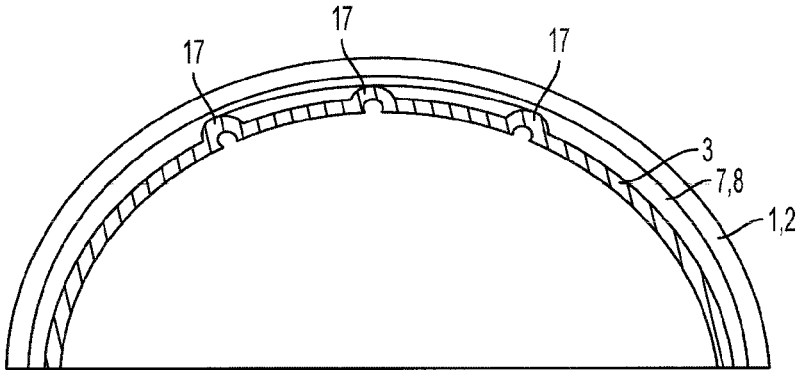
Figure 8:
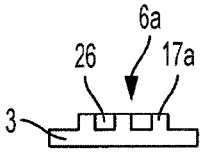
Figure 9:
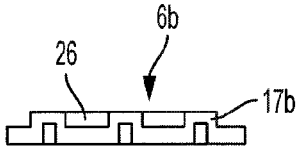
Figure 10:
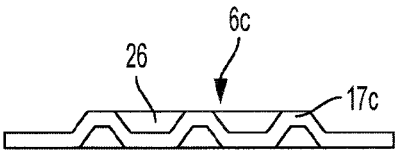
Figure 11:
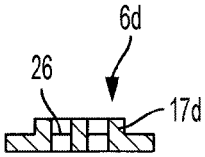

The drawings show in:

FIG. 1: perspective top view of an impact protection cap according to the invention;

FIG. 2: exploded view of the production position of the impact protection cap;

FIG. 3: a perspective representation of the arrangement according to FIG. 2;

FIG. 4: the top view of the impact protection cap assuming a relatively large head size;

FIG. 5: the same top view as in FIG. 4 assuming a small head size;

FIG. 6: section along line VI-VI in FIG. 5 (partially schematic);

FIG. 7: section along line VII-VII—partially schematic;

FIG. 8: a second embodiment of the profiling of a ribbing;

FIG. 9: a third embodiment of the ribbing;

FIG. 10: a fourth embodiment of the ribbing;

FIG. 11: a fifth embodiment of the ribbing.

In FIGS. 1 through 3, it can be seen that the impact protection cap essentially comprises a middle shell 3 which is constructed relatively narrow and whereto two lateral shells 1, 2 are appended in the frontal forehead area, said lateral shells 1, 2 being moulded onto said area as one piece from the same synthetic material.

Each lateral shell 1, 2 is equipped with a holding strap 4 and the holding straps 4, coordinated with one another, are interlocked by a closure 5 in the area of the back of the head.

The middle shell 3 according to the invention is preferably equipped with a ribbing 6 comprising longitudinal and crosswise ribs.

It is of importance that the lateral shells 1 and 2 overlap on the middle shell 3, hereby generating ventilation slots 7 constructed in horizontal direction, in the intermediate space between the upper side of the middle shell 3 and the respective underside of the respective lateral shell 1, 2.

Lateral ventilation slots 7, 8 thus are constructed and, based on their great length and relatively narrow cross section, function as venturi tubes when an air flow flows in the direction of the longitudinal axis of the middle shell over the middle shell building a semi-open flow channel.

For the purpose of adaptation to different head sizes, every lateral shell 1, 2 is adjustably guided on the middle shell 3 with the aid of a coordinated longitudinal guide.

In no wearing position is it provided to have the lateral shells 1, 2 separate from the middle shell 3 or cease to overlap. Accordingly, the lateral shells 1, 2 at least partially extend over and above the middle shell 3 uninterruptedly over the entire length of the middle shell. In this manner, it is always made certain according to FIG. 1 that the entire head area is protected from injuries uninterruptedly and without impairment caused by a slot of any kind.

FIGS. 2 and 3 therefore only show the production position during manufacture of an impact protection cap of this type, which is assembled after the production described therein into the form according to FIG. 1.

Further details are known from FIGS. 2 and 3. It can be seen that a connective plate 11 is disposed in the frontal forehead area, said connective plate 11 building vertical bendable areas 12 whereto the two lateral shells 1, 2 are appended as one piece of material. The latter thus are appended freely bendably to the connective plate 11 by means of the bendable areas 12.

The middle shell 3 also is appended to the connective plate 11 by means of a horizontal bendable area 13.

It is true that the bendable areas 12, 13 may be constructed as film hinges. This however is not necessary for the solution. It is sufficient to construct the connective plate 11 of the same synthetic material as the lateral shells 1, 2 and the middle shell 3 so that on the whole, said synthetic parts are conjoint with one another and are constructed from the same material. They are manufactured as integral part in an injection moulding mould.

In the embodiment according to FIGS. 1 through 3, the longitudinal guide 9 is constructed from slots 14 disposed respectively in the area of the lateral shells 1, 2, while stud bolts 15 are disposed in said slots 14, said stud bolts 15 being fastened to the middle shell 3. The stud bolts reach through the slots 14 and are guided longitudinally in the slots.

In kinematic reversal, however, it may also be provided to have stud bolts disposed in the area of the lateral shells and to have the coordinated slots disposed in the area of the middle shell 3.

Instead of the herein described longitudinal guide with slots and stud bolts, there is a multitude of other possibilities for longitudinal guides of this type. Therefore, all longitudinal guides known in the prior art are claimed as essential for the invention. Longitudinal guides of this type are, for example, matched joint longitudinal guides, dovetail guides, or flap guides, wherein a flap reaches into a coordinated groove located on the opposite side, and similar guides.

FIG. 2 shows, moreover, that the holding straps 4 are also attached to the lateral shells 1, 2 as one piece of material by means of bendable zones 10, thereby ensuring a particularly simple manufacture, when the holding straps 4 also are integrally connected to the lateral shells 1, 2 and the lateral shells 1, 2 in turn form an integral work piece with the middle shell 3.

Furthermore, it can be deduced from FIG. 2 that the middle shell 3 is equipped with a back-of-the-head flap 18 in the area of the back of the head, said back-of-the-head flap 18 being constructed as freely bendable; and by means of a bendable zone 19 disposed in said area, the back-of-the-head flap 18 is constructed to be bendable in the direction of the arrows 20.

This decisively contributes to ensuring the longitudinal adjustment for smaller (shorter) head shapes, while the back-of-the-head flap 18 is appended, spring-loaded, to the internal space of the lateral shells 1, 2 in the area of the back of the head, thereby forming a closed shell form so that the area of the back of the head is protected completely and comprehensively by the lateral shells 1, 2 and the back-of-the-head flap 18.

According to FIG. 2, the ribbing 6 comprises longitudinal ribs 16 and crosswise ribs 17 running crosswise to the former. They are shaped as semi-open ribs out of the material of the middle shell 3.

FIGS. 4 and 5 show the adaptation to different head sizes, where it can be seen that the impact protection cap according to FIG. 4 is adapted to a large head size because the longitudinal guide 9 is resting against the internal terminal stop thereof. If on the other hand a narrow head shape is to be achieved, the two lateral shells 1, 2 are simply moved against one another in direction of arrows 21, whereby the stud bolts are displaced in the longitudinal guide 9 and hereby a smaller head size according to FIG. 5 is achieved.

The smaller head size then is fixated by adjusting the holding strap 4 in connection with the closure 5.

From the comparison of FIGS. 4 and 5, it can be seen, moreover, that overlap areas 22 are generated between the lateral shells 1, 2 and the middle shell 3, said overlap areas 22 being always maintained, independently from the head size. With large head sizes, the overlap areas 22 are relatively small, while large overlap areas 22' exist with small head sizes.

It is of importance that the ventilation slots 7, 8 are constructed in the area of said overlap areas 22, 22' and extend over the entire length of the impact protection cap, whereby an excellent ventilation effect is achieved which is still greatly improved in the case of high air velocity in longitudinal direction to the middle shell. An effect of this type also arises when the impact protection cap is fitted into a textile hat or similar, as long as the textile fabric is sufficiently air-permeable.

FIG. 6 shows the effect of said ventilation slots 7, 8 in the overlap area 22, 22'. Here it can be seen that based on the ribbing 6, the middle shell 3 assumes a distance from the two lateral shells 1, 2 located thereabove, whereby the ventilation slots 7, 8 are formed and an air flow is sucked off outward at high velocity from the ventilation slots 7, 8 functioning like venturi tubes, in direction of the arrows 25.

FIG. 7 shows the effect of the crosswise ribs 17 which are, for example, constructed as semi-round profiles.

FIGS. 8 through 11 show other embodiments of the ribbing, wherein always a ventilation space 26 is formed by the ribbing 6*a*-6*d*.

In FIG. 8 it can be seen that the ribbing 6*a* may comprise rectangle-shaped crosswise ribs 17*a* building therebetween the ventilation spaces 26. FIG. 9 shows a similar representation, wherein however the crosswise ribs 17*b* are constructed broader and larger.

FIG. 10 shows crosswise ribs 17*c* of this type constructed in trapezoid form, while FIG. 11 shows that crosswise ribs of this type may also be open-worked in order to thereby achieve continuous ventilation spaces in direction of the scalp of the wearer. Thus the middle shell 3 is also constructed as open-worked in the area of the ribbing.

Naturally the invention can in addition provide for provision of corresponding ventilation openings in the area of the lateral shells 1, 2.

| Legend of Drawings | |
|---|---|
| 1 | lateral shell |
| 2 | lateral shell |
| 3 | middle shell |
| 4 | holding strap |
| 5 | closure |
| 6 | ribbing |
| 7 | ventilation slot |
| 8 | ventilation slot |
| 9 | longitudinal guide |
| 10 | bendable zone |
| 11 | connective plate |
| 12 | bendable area (vertical) |
| 13 | bendable area (horizontal) |
| 14 | slot |
| 15 | stud bolt |
| 16 | longitudinal rib |
| 17 | crosswise rib a, b, c, d |
| 18 | back-of-the-head flap |
| 19 | bendable zone |
| 20 | direction of arrow |
| 21 | direction of arrow |
| 22 | overlap area 22' |
| 23 | |
| 24 | |
| 25 | direction of arrow |
| 26 | ventilation space |

The invention claimed is:

1. An impact protection cap that is made of bendable synthetic material, said impact protection cap comprising:

a connective plate that is formed of a given type of material;

first and second lateral shells that are formed of the same type of given material as said connective plate, each of said first and second lateral shells being laterally conjoined to said connective plate by respective vertical bendable areas such that said first and second shells are integral with said connective plate; and at least one middle shell that is formed of the same type of given material as said connective plate, said middle shell having a longitudinal axis and being conjoined to said connective plate by a horizontal bendable area that is located on said connective plate between said respective vertical bendable areas of said first lateral shell and said second lateral shell such that said middle shell is integral with said connective plate, said middle shell having a length dimension in the direction of the longitudinal axis of said middle shell, said middle shell also having a flap that includes a bendable zone such that said flap is bendable with respect to the longitudinal axis of said middle shell, said middle shell cooperating with said first and second lateral shells and cooperating with said connective plate to form the impact protection cap with each of said first and second lateral shells at least partially extending over and above said middle shell uninterruptedly over the entire length of the middle shell to form a respective overlap area that defines at least one ventilation slot between said middle shell and said first lateral shell and at least one ventilation slot between said middle shell and second lateral shell.

2. The impact protection cap according to claim 1 wherein each of said overlap areas formed by the middle shell and a respective lateral shell includes a respective longitudinal guide that is oriented approximately crosswise to the longitudinal axis of said middle shell.

3. The impact protection cap according to claim 2 wherein said middle shell defines an upper side and wherein each of said first and second lateral shells defines an underside surface such that, at times when said lateral shells overlap the middle shell, said middle shell cooperates with at least one of said first and second lateral shells to define an intermediate space between the upper side of the middle shell and the underside surface of said at least one of said first and second lateral shells, said intermediate space defining said at least one ventilation slot.

4. The impact protection cap according to claim 3, wherein air-flow through said at least one ventilation slot is oriented in a direction that is approximately perpendicular to the longitudinal axis of said middle shell.

5. The impact protection cap according to claim 3 wherein said at least one ventilation slot defines a length that is approximately the same as the length that the first or second lateral shells overlap the middle shell.

6. The impact protection cap according to claim 1, wherein a respective holding strap is moulded onto each of said first and second lateral shells, said impact protection cap further comprising a closure that cooperates with each respective holding strap to interlock each holding strap.

7. The impact protection cap according to claim 3, wherein the underside surfaces of said first and second lateral shells that oppose the upper side of said middle shell are smooth and wherein the middle shell includes a ribbing that is located opposite the underside surfaces of the first and second lateral shells, said ribbing maintaining said middle shell apart from the underside surfaces of said first and second lateral shells to define said at least one ventilation slot.

8. An impact protection cap according to claim 1, wherein the surfaces of said first and second lateral shells that oppose said middle shell are smooth, and the lateral shells are equipped with ribbings at least in the area of the overlap, said ribbings being spaced and building ventilation slots.

9. An impact protection cap according to claim 1, wherein said middle shell and said lateral shells each include ribbings at least in the area of the respective overlap that is formed by, said middle shell and one of said first or second lateral shells, said ribbings being spaced apart and maintaining said middle shell apart from one of said first and second lateral shells to define said ventilation slots.

10. The impact protection cap according to claim 1, and further comprising bores, slots, or perforations that are in the middle shell and/or in the first and second lateral shells to provide ventilation to the user.

* * * * *